US008318645B2

(12) United States Patent
Kamimura

(10) Patent No.: US 8,318,645 B2
(45) Date of Patent: Nov. 27, 2012

(54) LUBRICANT COMPOSITION

(75) Inventor: Hideto Kamimura, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 538 days.

(21) Appl. No.: 12/096,711

(22) PCT Filed: Dec. 7, 2006

(86) PCT No.: PCT/JP2006/324428

§ 371 (c)(1),
(2), (4) Date: Jun. 9, 2008

(87) PCT Pub. No.: WO2007/066713

PCT Pub. Date: Jun. 14, 2007

(65) Prior Publication Data

US 2009/0186785 A1 Jul. 23, 2009

(30) Foreign Application Priority Data

Dec. 9, 2005 (JP) ..... 2005-356589

(51) Int. Cl.
*C10M 137/04* (2006.01)
*C10M 169/04* (2006.01)

(52) U.S. Cl. ..... 508/287; 508/441

(58) Field of Classification Search ..... 508/281, 508/441

See application file for complete search history.

(56) References Cited

U.S. PATENT DOCUMENTS

| | | | | |
|---|---|---|---|---|
| 3,006,945 | A | 10/1961 | Goddard et al. | |
| 3,534,127 | A * | 10/1970 | Spivack | 558/110 |
| 5,186,852 | A * | 2/1993 | Ishida et al. | 508/563 |
| 2005/0107269 | A1* | 5/2005 | Yagishita et al. | 508/440 |

FOREIGN PATENT DOCUMENTS

| | | |
|---|---|---|
| EP | 0 416 914 | 3/1991 |
| JP | 56-73170 | 6/1981 |
| JP | 63 156899 | 6/1988 |
| JP | 03 095297 | 4/1991 |
| JP | 04 202398 | 7/1992 |
| JP | 06 240282 | 8/1994 |
| JP | 07 179874 | 7/1995 |
| JP | 7 252489 | 10/1995 |
| JP | 08 283767 | 10/1996 |
| JP | 9 296192 | 11/1997 |
| JP | 10 081890 | 3/1998 |
| JP | 11 035962 | 2/1999 |
| JP | 2000 129279 | 5/2000 |
| JP | 2005 194416 | 7/2005 |
| JP | 2005 239897 | 9/2005 |

OTHER PUBLICATIONS

Japanese Official Action issued Dec. 13, 2011, in Japan Patent Application No. 2005-356589.

* cited by examiner

*Primary Examiner* — Walter D Griffin
*Assistant Examiner* — Francis C Campanell
(74) *Attorney, Agent, or Firm* — Oblon, Spivak, McClelland, Maier & Neustadt, L.L.P.

(57) ABSTRACT

The lubricating oil composition of the invention includes a base oil composed of mineral oil and/or synthetic oil, an amine antioxidant (A-1) in an amount of 800 ppm or more as reduced to the total amount of nitrogen, and a compound containing phosphorus and/or sulfur (A-2). The invention provides a compressor oil which realizes thermal/oxidation stability, resistance to sludge formation, lubricity, long service life, and water separation at high levels.

15 Claims, 1 Drawing Sheet

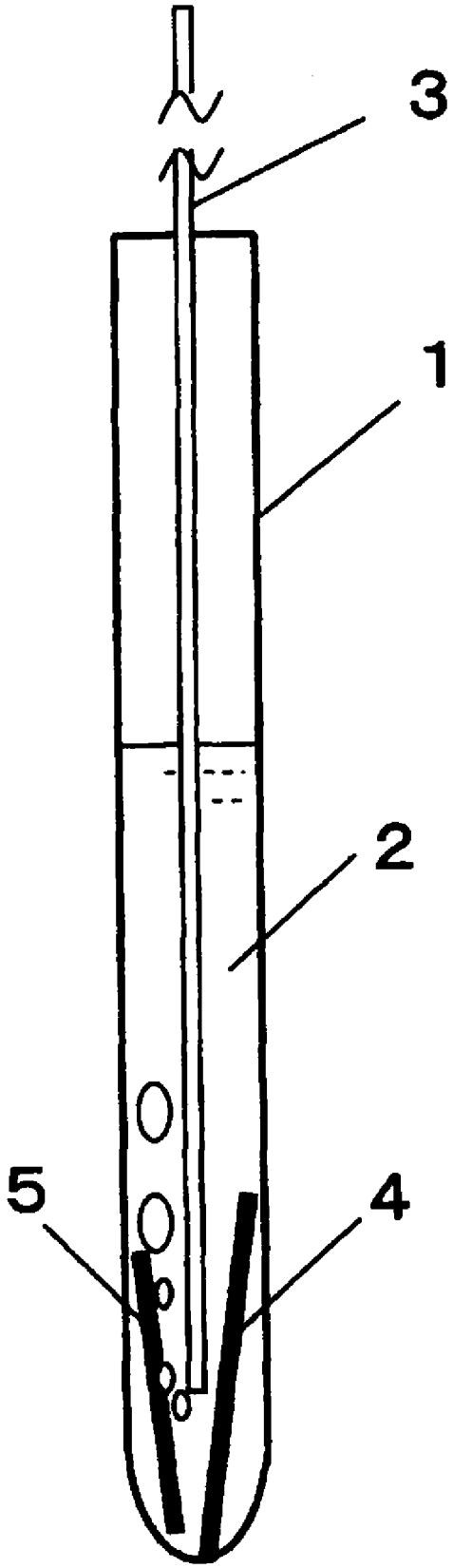
3
1
2
5
4

LUBRICANT COMPOSITION

This application is a 371 of PCT/JP324428, filed Dec. 7, 2006.

TECHNICAL FIELD

The present invention relates to a novel lubricating oil composition exhibiting remarkably excellent thermal/oxidation stability and resistance to sludge formation, and more particularly, to a lubricating oil composition suitable for a compressor oil composition.

BACKGROUND ART

A compressor is a machine which compresses a gas medium (e.g., air, nitrogen gas, oxygen gas, hydrogen gas, ammonia gas, carbon dioxide gas, carbon monoxide gas, or hydrocarbon gas) by means of external work and which feeds pressure-elevated compressed gas. Compressors are divided into a positive displacement compressor and a rotodynamic compressor, on the basis of the operational mechanism of elevating air or gas pressure. The positive displacement compressor is classified into a reciprocating-type compressor and a rotary-type compressor.

As compared with conventional reciprocating-type compressors, rotary-type compressors have been more widely used, from the viewpoints of resource saving, reduction of noise and vibration, efficiency, etc.

In rotary-type compressors, lubricating oil is in contact with high-temperature and high-pressure air or gas. That is, rotary-type compressors are operated under more severe conditions as compared with reciprocating-type compressors. Therefore, a compressor oil employed in rotary-type compressors must have higher thermal/oxidation stability.

Meanwhile, rotary compressors have been more and more downsized recently, and are often operated under severe conditions; for example, in an oxidizing gas such as $SO_X$ or $NO_X$ or a cutting mist atmosphere. In such a case, sludge is formed in lube oil, which is immediately deposited on an inner portion of the compressors or causes clogging of a filter, in some cases resulting in operation failure.

Under such circumstances, there is demand for a lube oil having high resistance to sludge formation.

Patent Document 1 discloses a lubricating oil composition essentially containing N-p-alkylphenyl-α-naphthylamine having a branched alkyl group derived from propylene oligomer, and p,p'-dialkyldiphenylamine having a branched alkyl group derived from propylene oligomer.

Patent Document 2 discloses a lubricating oil composition containing N-p-alkylphenyl-α-naphthylamine and p,p'-dialkyldiphenylamine in specific amounts with a specific ratio by weight.

Patent Document 3 discloses a lubricating oil composition containing 2-tert-butyl-4-alkyloxymethyl-6-alkylphenol (a phenol-based antioxidant), N-p-alkylphenyl-α-naphthylamine, and p,p'-dialkyldiphenylamine.

Patent Document 4 discloses a lubricating oil composition containing a phosphorus-containing phenol-based antioxidant, a phosphorus-free phenol-based antioxidant, and an amine antioxidant.

Patent Document 5 discloses a lubricating oil composition containing phenyl-α-naphthylamine, p,p'-dialkyldiphenylamine, and a phosphorus-containing extreme-pressure agent.

However, those lubricating oil compositions disclosed in the Patent Documents cannot simultaneously attain high levels of thermal/oxidation stability, resistance to sludge formation, lubricity, long service life, or water separation for use as compressor oil. Therefore, further improvement has been demanded for the performance of the lubricating oil compositions.

Patent Document 1: Japanese Patent Application Laid-Open (kokai) No. 3-95297

Patent Document 2: Japanese Patent Application Laid-Open (kokai) No. 7-252489

Patent Document 3: Japanese Patent Application Laid-Open (kokai) No. 9-296192

Patent Document 4: Japanese Patent Application Laid-Open (kokai) No. 11-35962

Patent Document 5: Japanese Patent Application Laid-Open (kokai) No. 2005-239897

DISCLOSURE OF THE INVENTION

Problems to be Solved by the Invention

The present invention has been accomplished under such circumstances. Thus, an object of the present invention is to provide a lubricating oil composition which is excellent in thermal/oxidation stability, resistance to sludge formation, lubricity, long service life, and water separation, and more particularly to provide a lubricating oil composition suitable for a compressor oil composition.

Means for Solving the Problems

The present inventor has carried out extensive studies in an attempt to develop a compressor oil which is excellent in thermal/oxidation stability and resistance to sludge formation, and have found that the above object can be attained by a lubricating oil composition comprising a base oil composed of mineral oil or synthetic oil, and an amine antioxidant, and a compound containing phosphorus and/or sulfur having a specific structure being added to the base oil.

Accordingly, the present invention provides the following:

(1) a lubricating oil composition, characterized by comprising a base oil composed of mineral oil and/or synthetic oil, an amine antioxidant (A-1) in an amount of 800 ppm or more as reduced to the total amount of nitrogen, and a compound containing phosphorus and/or sulfur (A-2);

(2) a lubricating oil composition as described in (1) above, wherein the amine antioxidant (A-1) is a diphenylamine compound and/or a phenyl-α-naphthylamine compound;

(3) a lubricating oil composition as described in (1) or (2) above, wherein the compound containing phosphorus and/or sulfur (A-2) is represented by formula (I):

[F1]

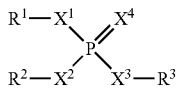

(I)

(wherein each of $R^1$ to $R^3$, which may be identical to or different from one another, represents a hydrogen atom, a hydrocarbon group, or a di-t-butylphenol group; and each of $X^1$ to $X^4$, which may be identical to or different from one another, represents an oxygen atom or a sulfur atom); or by formula (II):

[F2]

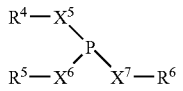

(II)

(wherein each of $R^4$ to $R^6$, which may be identical to or different from one another, represents a hydrogen atom or a hydrocarbon group; and each of $X^5$ to $X^7$, which may be identical to or different from one another, represents an oxygen atom or a sulfur atom); or by formula (III):

$$R^7—OOC-A^1-S_X-A^1-COO—R^8 \quad (III)$$

(wherein each of $R^7$, $R^8$, and $A^1$ represents a hydrocarbon group, wherein $R^7$ and $R^8$ may be identical to or different from each other; and x is an integer of 1 to 4);

(4) a lubricating oil composition as described in any one of (1) to (3) above, wherein the compound containing phosphorus and/or sulfur as recited in (3) above is a phosphorus-containing compound represented by formula (IV):

[F3]

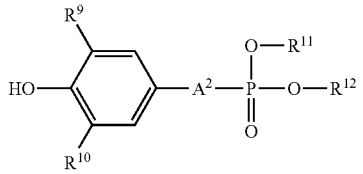

(IV)

(wherein each of $A^2$ and $R^9$ to $R^{12}$ represents a hydrocarbon group, wherein $R^9$ to $R^{12}$ may be identical to or different from one another).

Effects of the Invention

Since the lubricating oil composition according to the present invention contains an amine antioxidant in an amount, as reduced to the total amount of nitrogen contained in the amine antioxidant, of 800 ppm or more, and a compound containing phosphorus and/or sulfur represented by formula (I), (II), or (III), thermal/oxidation stability, resistance to sludge formation, lubricity, long service life, and water separation can be attained at high levels. In particular, the composition can realize continuous operation of a compressor for a long period of time.

BRIEF DESCRIPTION OF THE DRAWING

[FIG. 1] A sketch of an Indiana oxidation text apparatus.

DESCRIPTION OF REFERENCE NUMERALS

1: Sample container
2: Sample
3: Air-introduction pipe
4: Iron catalyst
5: Copper catalyst

BEST MODES FOR CARRYING OUT THE INVENTION

A characteristic feature of the lubricating oil composition according to the present invention resides in that the composition contains a base oil composed of mineral oil and/or synthetic oil, an amine antioxidant (A-1) in an amount of 800 ppm or more as reduced to the total amount of nitrogen, and a compound containing phosphorus and/or sulfur (A-2) represented by formula (I), (II), or (III).

The amine antioxidant is incorporated into the lubricating oil composition such that the total amount of nitrogen of the amine antioxidant is adjusted to 800 ppm or more. When the total amount of nitrogen is 800 ppm or more, the effect of combination of the antioxidant and component (A-2)—a phosphorus-containing compound and/or a sulfur compound—can be satisfactorily attained. In addition, when the total amount of nitrogen is 3,000 ppm or less, solubility of the antioxidant in the lubricating oil composition, cost, and antioxidation performance can be balanced. More preferably, the total amount of nitrogen 800 to 2,000 ppm, particularly preferably 900 to 1,500 ppm.

Examples of the amine antioxidant which may be used in the present invention include alkyldiphenylamines such as p,p'-dioctyldiphenylamine, p,p'-di-α-methylbenzyldiphenylamine, N-p-butylphenyl-N-p'-octylphenylamine, mono-t-butyldiphenylamine, and monooctyldiphenylamine; phenyl-α-naphthylamines such as methylphenyl-1-naphthylamine, ethylphenyl-1-naphthylamine, butylphenyl-1-naphthylamine, hexylphenyl-1-naphthylamine, octylphenyl-1-naphthylamine, and N-t-dodecylphenyl-1-naphthylamine; bis(dialkylphenyl)amines such as di(2,4-diethylphenyl)amine and di(2-ethyl-4-nonylphenyl)amine; aryl-naphthylamines such as 1-naphthylamine, phenyl-1-naphthylamine, phenyl-2-naphthylamine, N-hexylphenyl-2-naphthylamine, and N-octylphenyl-2-naphthylamine; phenylenediamines such as N,N'-diisopropyl-p-phenylenediamine and N,N'-diphenyl-p-phenylenediamine; and phenothiazines such as phenothiazine and 3,7-dioctylphenothiazine.

Of these, use of phenyl-α-naphthylamine and alkyldiphenylamine singly or in combination of two species is particularly preferred. Use in combination of dioctyldiphenylamine and N-(p-octylphenyl)-1-naphthylamine is particularly preferred, from the viewpoints of service life to oxidation and resistance to sludge formation.

The phosphorus-containing compound serving as a compound containing phosphorus and/or sulfur (A-2) is particularly preferably represented by formula (I):

[F4]

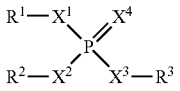

(I)

(wherein each of $R^1$ to $R^3$, which may be identical to or different from one another, represents a hydrogen atom, a hydrocarbon group, or a di-t-butylphenol group; and each of $X^1$ to $X^4$, which may be identical to or different from one another, represents an oxygen atom or a sulfur atom); or by formula (II):

[F5]

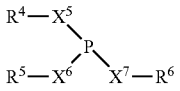

(II)

(wherein each of $R^4$ to $R^6$, which may be identical to or different from one another, represents a hydrogen atom or a hydrocarbon group; and each of $X^5$ to $X^7$, which may be identical to or different from one another, represents an oxygen atom or a sulfur atom).

The sulfur-containing compound which may be used in the present invention is a thioglycolic acid ester represented by formula (III):

$$R^7—OOC-A^1-S_X-A^1-COO—R^8 \quad (III)$$

(wherein each of $R^7$, $R^8$, and $A^1$ represents a hydrocarbon group, wherein $R^7$ and $R^8$ may be identical to or different from each other; and x is an integer of 1 to 4).

Examples of the ester include dibutyl thiopropionate, dioctyl thiopropionate, ditridecyl thiopropionate, and stearyl-(3,5-dimethyl-4-oxybenzyl) thioglycolate.

The phosphorus-containing compound which may be used in the invention preferably has a chemical structure represented by formula (IV).

[F6]

(IV)

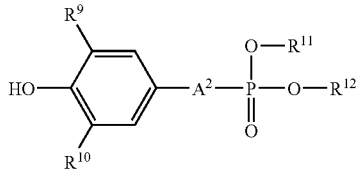

In formula (IV), each of $A^2$ and $R^9$ to $R^{12}$ represents a hydrocarbon group, and $R^9$ to $R^{12}$ may be identical to or different from one another. The hydrocarbon group represented by $A^2$ in formula (IV) is preferably an alkylene group having 1 to 8 carbon atoms (e.g., methylene, ethylene, or propylene). The hydrocarbon group represented by each of $R^9$ to $R^{12}$ is preferably an alkyl group having 1 to 24 carbon atoms, more preferably an alkyl group having 1 to 8 carbon atoms (e.g., methyl, ethyl, propyl, tert-butyl, or 2-ethylhexyl).

Specifically, diethyl [[3,5-bis(1,1-dimethylethyl)-4-hydroxyphenyl]methyl] phosphonate and diethylhexyl acid phosphate are preferably used.

The lubricating oil composition of the present invention includes a base oil composed of mineral oil and/or synthetic oil, an amine antioxidant (A-1) in an amount of 800 ppm or more as reduced to the total amount of nitrogen, and a compound containing phosphorus and/or sulfur (A-2) represented by formula (I), (II), or (III). The amount of the compound containing phosphorus and/or sulfur is preferably 0.05 to 2% by mass, more preferably 0.1 to 1% by mass, from the viewpoint of attaining the aforementioned effect.

As the base oil of the lubricating oil composition of the present invention, either mineral oil or synthetic oil may be used.

One example of the mineral base oil is a refined fraction produced through subjecting a lube oil fraction which has been obtained through distillation of crude oil at ambient pressure and distillation of the residue under reduced pressure, to at least one treatment such as solvent deasphalting, solvent extraction, hydro-cracking, solvent dewaxing, or hydro-refining. Another example of the mineral base oil is a base oil produced through isomerization of mineral oil wax or isomerization of wax (gas-to-liquid wax) produced through, for example, the Fischer-Tropsch process.

As the synthetic oil, a variety of known synthetic oils may be employed. Examples include poly(α-olefin) (including α-olefin copolymer), polybutene, polyol-ester, dibasic acid esters, phosphate esters, poly(phenyl ether), alkylbenzene, alkylnaphthalene, polyoxyalkylene glycol, neopentyl glycol, silicone oil, trimethylolpropane, pentaerythritol, and hindered esters.

These base oils may be used singly or in combination of two or more species, and a mineral oil and a synthetic oil may be used in combination.

The base oil preferably has a kinematic viscosity (40° C.) of 5 to 460 $mm^2/s$ and a % $C_A$ of 10 or lower. When the kinematic viscosity falls within the above range, friction at a sliding part such as a gear bearing of a compressor or an automatic transmission or a clutch can be satisfactorily reduced, and characteristics of the oil composition at low temperatures can be improved. The kinematic viscosity as determined at 40° C. is preferably 10 to 320 $mm^2/s$, particularly preferably 22 to 220 $mm^2/s$.

When the % $C_A$ is 10 or lower, oxidation stability can be enhanced. The % $C_A$ is preferably 3 or lower, particularly preferably 1 or lower.

Notably, % $C_A$ is determined through n-d-M ring analysis method.

The base oil preferably has a sulfur content of 100 mass ppm or lower. When the sulfur content is 100 mass ppm or lower, good oxidation stability can be attained.

In order to enhance the performance of the lubricating oil composition of the present invention, at least one detergent dispersant may be incorporated thereinto. Examples of the detergent dispersant include metal sulfonates, metal salicylates, metal phenates, and alkenylsuccinimides.

These detergent dispersants may be used singly or in combination of two or more species.

The lubricating oil composition of the present invention may further contain other antioxidants in combination. In particular, a phenol-based antioxidant may be included. Examples of the phenol-based antioxidant include monocyclic phenols such as 2,6-di-tert-butyl-4-methylphenol, 2,6-di-tert-butyl-4-ethylphenol, 2,4,6-tri-tert-butylphenol, 2,6-di-tert-butyl-4-hydroxymethylphenol, 2,6-di-tert-butylphenol, 2,4-dimethyl-6-tert-butylphenol, 2,6-di-tert-butyl-4-(N,N-dimethylaminomethyl)phenol, 2,6-di-tert-amyl-4-methylphenol, and n-octadecyl-3-(4'-hydroxy-3',5'-di-tert-butylphenyl) propionate; and polycyclic phenols such as 4,4'-methylenebis(2,6-di-tert-butylphenol), 4,4'-isopropylidenebis(2,6-di-tert-butylphenol), 2,2'-methylenebis(4-methyl-6-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 4,4'-butylidenebis(3-methyl-6-tert-butylphenol), 2,2'-thiobis(4-methyl-6-tert-butylphenol), and 4,4'-thiobis(3-methyl-6-tert-butylphenol).

Among them, phenols having a molecular weight of 340 or higher are preferred, since such phenols exhibit excellent antioxidation performance against a short-term high-temperature history under high pressure.

These phenol-based antioxidants may be used singly or in combination of two or more species. The amount of the phenol-based antioxidant is selected from 0.01 to 5% by mass based on the total amount of the composition. When the amount is less than 0.01% by mass, the effect of the phenol-based antioxidant may be insufficient, whereas when the amount is in excess of 5% by mass, the effect commensurate with the addition cannot be attained. Furthermore, the antioxidant may be precipitated at low temperature, and such addition is economically disadvantageous. The amount of the phenol-based antioxidant is preferably 0.1 to 2% by mass based on the total amount of the composition, from the viewpoints of antioxidation performance, prevention of precipitation at low temperature, cost, etc.

The lubricating oil composition of the present invention may further contain additives other than the aforementioned detergent dispersant. Examples of the additives include an ash-free dispersant, a metallic detergent, a friction modulators, a viscosity index improver, an extreme-pressure agent, an antioxidant, an anti-corrosive agent, a defoamer, and a colorant. These additives may be used singly or in combination of two or more species.

These known additives may be used in a desired amount. When these additive are used, the amount of antioxidant is generally 0.01 to 5.0% by mass, the amount of rust-preventive agent or anti-corrosive agent is generally 0.01 to 3.0% by mass, the amount of anti-wearing agent is generally 0.1 to 5.0% by mass, the amount of pour point depressant is generally 0.05 to 5% by mass, and the amount of defoamer is generally 0.01 to 0.05% by mass, with respect to the total amount of the lubricating oil.

Since the thus-prepared lubricating oil composition of the present invention contains an amine antioxidant in an amount of 800 ppm or more as reduced to the total amount of nitrogen, and a compound containing phosphorus and/or sulfur represented by formula (I), (II), or (III), thermal/oxidation stability, resistance to sludge formation, lubricity, long service life, and water separation can be attained at high levels. In particular, the composition can realize continuous operation of a compressor for a long period of time, and can be suitably employed as a lubricating oil of a compressor (i.e., compressor oil). Other than compressor oil, the composition of the present invention can be suitably employed as a variety of lubricating oils such as turbine oil, hydraulic oil, gear oil, and bearing oil.

EXAMPLES

The present invention will next be described in more detail by way of examples, which should not be construed as limiting the invention thereto.

Examples 1 to 3 and Comparative Examples 1 and 2

In Examples 1 to 3 and Comparative Examples 1 and 2, the base oils and additives listed in Table 1 were mixed, to thereby prepare compressor oil compositions having a formulation shown in Table 1.

(Base Oil)

base oil 1: Poly-α-olefin (BP, DURASYN 166, product of Amoco)

(Additives)

B1: Dioctyldiphenylamine

C1: N-(p-Octylphenyl)-1-naphthylamine

D1: Diethyl[[3,5-bis(1,1-dimethylethyl)-4-hydroxyphenyl] methyl] phosphonate

E1: Ditridecyl thiopropionate

F1: 4,4'-Methylenebis(2,6-di-tert-butylphenol)

G1: Alkenylsccinic acid ester (anticorrosive)

H1: Dimethylsilicone (defoamer)

[Table 1]

TABLE 1

| | | | Ex. 1 | Ex. 2 | Ex. 3 | Comp. Ex. 1 | Comp. Ex. 2 |
|---|---|---|---|---|---|---|---|
| Formulation (% by mass) | base oil | base oil 1 | 96.789 | 96.789 | 96.589 | 98.30 | 97.30 |
| | A-1 | B1 | 2 | 2 | 2 | 1 | 2 |
| | | C1 | 0.5 | 0.5 | 0.5 | | |
| | A-2 | D1 | 0.2 | | 0.2 | 0.2 | 0.2 |
| | | E1 | | 0.2 | 0.2 | | |
| | | F1 | 0.5 | 0.5 | 0.5 | 0.5 | 0.5 |
| | | G1 | 0.01 | 0.01 | 0.01 | 0.01 | 0.01 |
| | | H1 | 0.001 | 0.001 | 0.001 | 0.001 | 0.001 |
| Total nitrogen (ppm) (N in amine antioxidant) | | | 910 | 910 | 910 | 350 | 700 |
| Acid value increase (mgKOH/g) | | | 1.83 | 1.98 | 1.72 | 3.8 | 3.14 |
| Continuous operation test (actual compressor) (hr) | | | 12,000 | 12,000 | 15,000 | 6,000 | 8,000 |

In all the Examples and Comparative Examples in Table 1, the base oil 1 was employed. A phenol-based antioxidant (F1), an anti-corrosive (G1), and a defoamer (H1) were added to each composition in a constant amount. The amount of amine antioxidant (A-1), and that of a phosphorus-containing compound or sulfur-containing compound (A-2) were modified.

The oxidation stability of each lubricating oil composition was evaluated through the Indiana oxidation test by use of an apparatus as shown in FIG. 1. Specifically, a sample 2 (300 mL) was placed in a sample container 1, and air was introduced to the container through an air-introduction pipe 3 at 10 L/h, whereby the oil composition was deteriorated in the presence of an iron catalyst 4 and a copper catalyst 5. The increase in acid value after the test (175° C. for 196 hours) was measured.

The continuous operation test was performed in an actual rotary compressor. Each composition was tested in the rotary compressor which was continuously operated at an average oil temperature of 80° C. and an average operation pressure of 0.7 MPa, under full load conditions without replenishment. Each lubricating oil composition was evaluated in terms of the time until the RBOT value (JIS K2514) was changed to shorter than 100 min. The time was employed as an index of the service life in the actual compressor.

As is clear form Table 1, the lubricating oil composition of the present invention exhibited a small increase in acid value, indicating that the composition has high oxidation resistance at high temperature and, therefore, ensures long-term operation of a compressor.

INDUSTRIAL APPLICABILITY

Since the lubricating oil composition of the present invention contains an amine antioxidant in an amount (as reduced to the total amount of nitrogen (contained in amine antioxidant)) of 800 ppm or more and a compound containing phosphorus and/or sulfur represented by formula (I), (II), or (III), thermal/oxidation stability, resistance to sludge formation, lubricity, long service life, and water separation can be attained at high levels. The composition of the present invention is particularly suitable as a compressor oil, which must be used in long-term operation.

The invention claimed is:

1. A lubricating oil composition, comprising:

a poly-α-olefin base oil, an amine antioxidant (A-1) comprising dioctyldiphenylamine and N-(p-octylphenyl)-1-naphthylamine in an amount of 800 ppm or more as reduced to the total amount of nitrogen, and a compound comprising phosphorus (A-2) represented by formula (IV):

(IV)

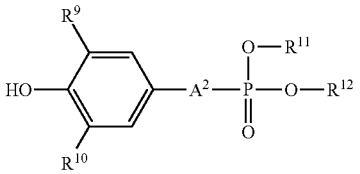

wherein each of $A^2$ and $R^9$ to $R^{12}$ represents a hydrocarbon group, wherein $R^9$ to $R^{12}$ may be identical to or different from one another.

2. A lubricating oil composition as described in claim 1, which further comprises at least one detergent dispersant selected from the group consisting of metal sulfonates, metal salicylates, metal phenates, and alkenylsuccinimides.

3. A lubricating oil composition as described in claim 1, wherein the base oil has a % $C_A$, as determined through the n-d-M ring analysis method, of 10 or lower.

4. A lubricating oil composition as described in claim 1, wherein the amine antioxidant (A-1) is present in an amount of 3,000 ppm or less as reduced to the total amount of nitrogen.

5. A lubricating oil composition as described in claim 1, wherein the amine antioxidant (A-1) is present in an amount of 900 to 1,500 ppm as reduced to the total amount of nitrogen.

6. A lubricating oil composition as described in claim 2, wherein the amine antioxidant (A-1) is present in an amount of 900 to 1,500 ppm as reduced to the total amount of nitrogen.

7. A lubricating oil composition as described in claim 1, wherein the amine antioxidant (A-1) is present in an amount of 3,000 ppm or less as reduced to the total amount of nitrogen and the compound containing phosphorus and/or sulfur is selected from diethyl [[3,5-bis(1,1-dimethylethyl)-4-hydroxyphenyl]methyl] phosphonate and diethylhexyl acid phosphate.

8. A lubricating oil composition as described in claim 4, wherein the base oil has a kinematic viscosity (40° C.) of 5 to 460 $mm^2/s$ and a % $C_A$ as determined through the n-d-M ring analysis method of 10 or lower.

9. A lubricating oil composition as described in claim 4, wherein the base oil has a kinematic viscosity (40° C.) of 22 to 220 $mm^2/s$ and a % $C_A$ as determined through the n-d-M ring analysis method of 3 or lower.

10. A lubricating oil composition as described in claim 1, comprising poly-α-olefin base oil, dioctyldiphenylamine, N-(p-octylphenyl)-1-naphthylamine, and diethyl[[3,5-bis(1,1-dimethylethyl)-4-hydroxyphenyl]methyl] phosphonate.

11. A lubricating oil composition as described in claim 10, further comprising 4,4'-Methylenebis(2,6-di-tert-butylphenol), alkenylsuccinic acid ester, and dimethylsilicone.

12. A lubricating oil composition as described in claim 1, comprising poly-α-olefin base oil, dioctyldiphenylamine, N-(p-octylphenyl)-1-naphthylamine, and ditridecyl thiopropionate.

13. A lubricating oil composition as described in claim 12, further comprising 4,4'-Methylenebis(2,6-di-tert-butylphenol), alkenylsuccinic acid ester, and dimethylsilicone.

14. A lubricating oil composition as described in claim 1, comprising poly-α-olefin base oil, dioctyldiphenylamine, N-(p-octylphenyl)-1-naphthylamine, diethyl[[3,5-bis(1,1-dimethylethyl)-4-hydroxyphenyl]methyl] phosphonate and ditridecyl thiopropionate.

15. A lubricating oil composition as described in claim 14, further comprising 4,4'-Methylenebis(2,6-di-tert-butylphenol), alkenylsuccinic acid ester, and dimethylsilicone.

* * * * *